US006385799B1

(12) United States Patent
Doyen

(10) Patent No.: US 6,385,799 B1
(45) Date of Patent: May 14, 2002

(54) PLUMBING SINK TRAP

(75) Inventor: Paul Andrew Doyen, Florence, KY (US)

(73) Assignee: Liming Properties, LLC

( * ) Notice: Subject to any disclaimer, the term of this patent is extended or adjusted under 35 U.S.C. 154(b) by 0 days.

(21) Appl. No.: 09/921,749

(22) Filed: Aug. 6, 2001

(51) Int. Cl.[7] ..... E03C 1/28

(52) U.S. Cl. ..... 4/679; 4/256.1; 137/242; 137/247.49

(58) Field of Search ..... 4/679, 256.1; 137/242, 137/247.49, 247.51

(56) References Cited

U.S. PATENT DOCUMENTS 232,376 A 9/1880 Staples
267,306 A * 11/1882 Gall ..... 4/679
1,817,376 A * 8/1931 Izquierdo ..... 4/679
2,059,733 A * 11/1936 Heisser
2,422,801 A * 6/1947 Rohling
2,602,168 A * 7/1952 Lally et al. ..... 4/256.1
2,610,696 A * 9/1952 Mayberry
2,627,610 A 2/1953 Hirshstein
3,396,752 A 8/1968 Strout et al.
3,765,439 A * 10/1973 Wise
3,872,521 A * 3/1975 Friedman ..... 4/679
4,615,053 A 10/1986 Masalin et al.
4,700,412 A 10/1987 Manuel
4,949,406 A * 8/1990 Canelli ..... 4/256.1
5,236,137 A * 8/1993 Coogan

* cited by examiner

*Primary Examiner*—Charles R. Eloshway
(74) *Attorney, Agent, or Firm*—Jacobson Holman, PLLC

(57) ABSTRACT

A plumbing sink trap having a rotatable actuating knob for rotating a sweeper bar through 360°. The sweeper bar forms a part of the U-shaped path for waste water. Rotation of the sweeper bar removes obstructions in the U-shaped path.

15 Claims, 2 Drawing Sheets

PLUMBING SINK TRAP

FIELD OF THE INVENTION

The present invention relates to a plumbing sink trap.

BACKGROUND OF THE INVENTION

Modern plumbing, while introducing extreme convenience, has introduced specialized problems. For example, over time, in a P-trap plumbing fitting, usually associated with a sink outlet, clogging may occur.

Traditionally, to solve this problem, a plumber needs to be called who removes two compression nuts located at opposite ends of the P-trap. A tailpiece is pushed down and the trap turned 90° to gain access to the U-shaped bend in the trap in which the clog resides.

The removal of the trap may cause spillage of waste water and other damage inherent in repair of a P-trap resulting in a need for possible replacement. In addition, the cost associated with the use of a plumber and loss of time for the homeowner may be prohibitive.

SUMMARY OF THE INVENTION

The present invention is designed to clear itself of stoppages or blockages in a trap pipe by turning an external knob. The knob is connected to an internal sweeper mechanism. The sweeper mechanism is permanently attached to the external knob by the use of a stem of a shaft. The shaft has a male spline on both ends. One end of the spline is received in a female splined opening of the external handle and the other end is received in a female seat of the sweeper mechanism.

The sweeper mechanism when not in use locks in an upright position. When the sweeper is in the upright position, its sidewalls form part of the U-shaped path of a regular sink P-trap.

To accomplish this, the present invention is designed in a circular configuration. The trap housing is a full 360 degree design with flat side walls.

The overall size of the housing is determined by the type of plumbing fixture to which the trap of the present invention is attached. The trap can be made in a variety of sizes, such as one and one quarter inch (1¼"), one and one half inch (1½") and two inch (2"). The trap is designed to maintain a true water seal of three and one half inches (3½") minimum.

The inlet and the outlet of the trap are of nominal pipe size. The inlet has a male thread and a female swedged opening to allow for a slip nut connection or solvent weld joint. The outlet has a male thread to allow for a slip nut connection to the crown weir. The trap is to be constructed of injection molded PVC (poly-vinyl-chloride).

Accordingly, it is an object of the present invention to provide a P-trap having a rotatable sweeper interposed between two vertically extending sidewalls such that the sweeper may be rotated 360 degrees to remove debris lodged in a U-shaped portion of the P-trap.

It is another object of the present invention to provide a plumbing sink trap having a vertically oriented sweeper bar forming part of a U-shaped path for passage of waste water and which upon blockage of the U-shaped path, is rotatable through 360 degrees for advancing the object blocking the U-shaped path.

It is still another object of the present invention to provide a plumbing sink trap having a vertically extending sidewall through which extends a spline connected to a sweeper bar within the sink trap and connected to a rotatable knob for rotation of the it sweeper bar through 360 degrees from outside of the trap so as to clear blockage of the sink trap.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
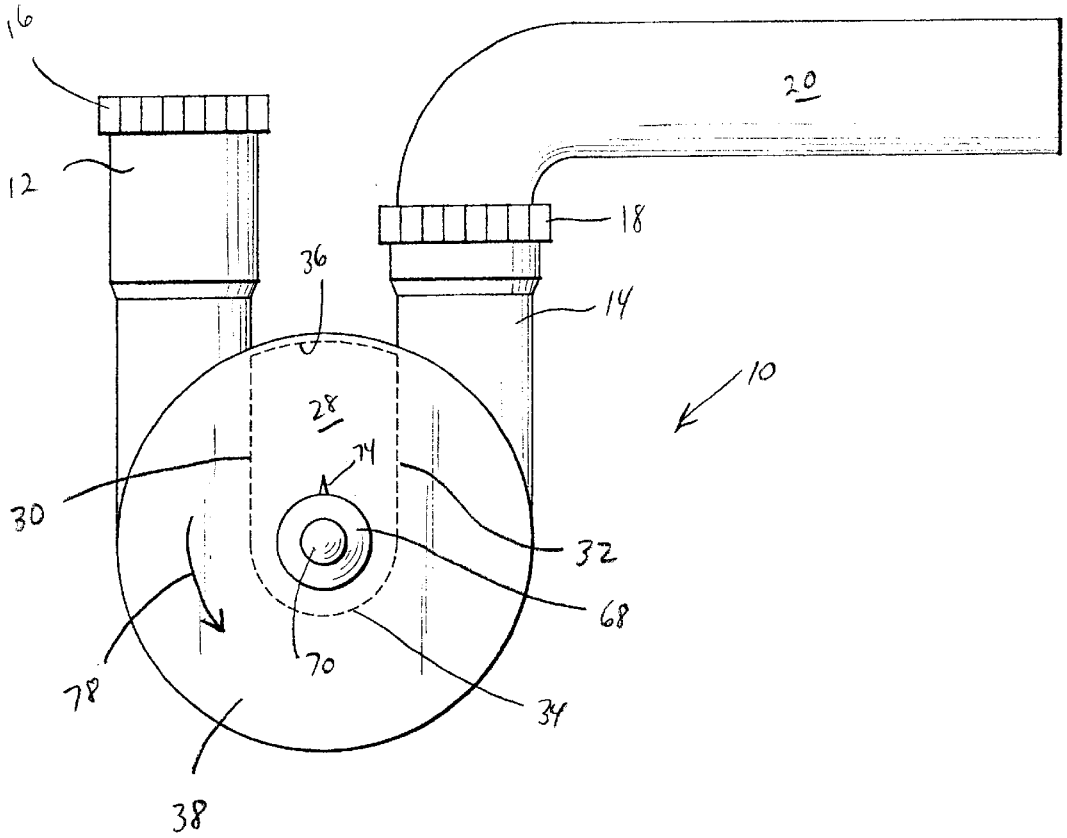
FIG. 1 is a side view of the plumbing sink trap of the present invention illustrating a sweeper bar located in a vertical orientation within the sink trap and being rotatable through 360 degrees upon rotation of an actuating knob.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings, in general and to FIG. 1 in particular, a plumbing sink P-trap embodying the teachings of the subject invention is generally designated as 10. The trap includes inlet end 12 and outlet end 14. The trap is made of poly-vinyl-chloride. Inlet end 12 and outlet end 14 each include a compression nut 16, 18, respectively.

Inlet end 12 may be connected to a tailpiece (not shown) whereas end 18 is connected to a waste pipe weir 20. Alternatively, solvent weld joints or threaded connections may be used since internal access to the sink trap will no longer be necessary by the present invention.

Figure 2:
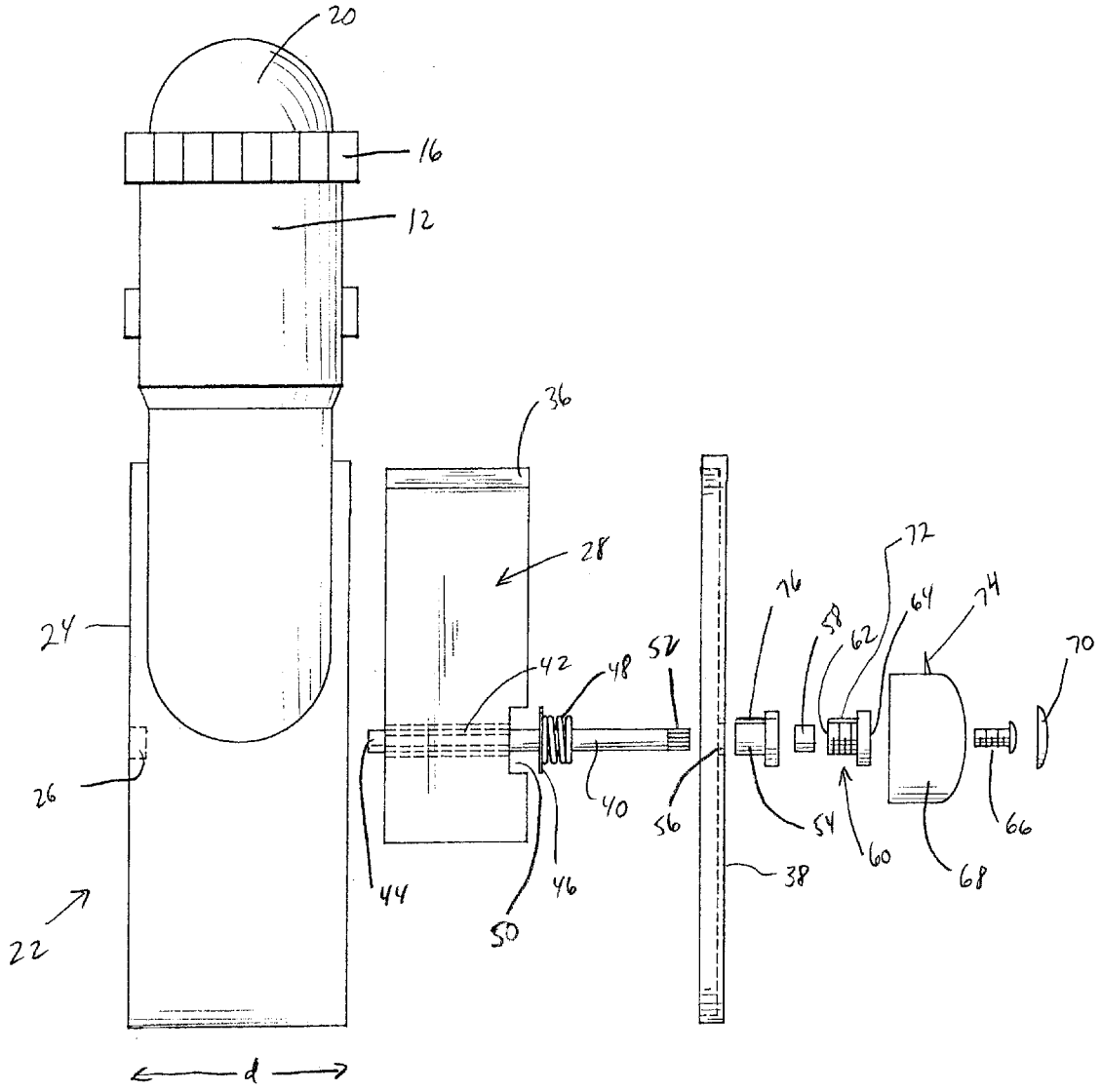
FIG. 2 is a rear exploded view of the plumbing sink trap of the present invention illustrating the mounting of the sweeper bar between a fixed sidewall of the sink trap body and a removable sidewall with the shaft upon which the sweeper bar is fixed extending through the removable sidewall for connection with a rotatable actuating knob for rotation of the sweeper bar through 360 degrees.

With reference to FIG. 2, the trap body 22 includes a fixed side wall 24 integral with inlet end 12 and outlet end 14. Projecting inwardly from side wall 24 is a female guide seat 26.

Sweeper bar 28 is a solid member having a width equal to the width "d" of the trap body 22. The sweeper bar includes two parallel sidewalls 30, 32 interconnecting two opposite curved ends 34, 36. The curvature of end 36 is the same curvature as the path of the sweeper bar 29 through the trap body 22, as shown in FIG. 1.

The sweeper bar is permanently secured on shaft 40 by a splined connection 42. End 44 of shaft 40 is received in guide seat 26, allowing complete freedom of rotation of the sweeper bar.

In a central portion of the shaft 40 is located a washer 46 and a bias spring 48 for compression by sidewall 38 when the sink trap is assembled. The washer 46 and spring 48 will be forced into recess 50 by trap side wall 38 with the spring 48 projecting slightly out of the recess 50 for bias engagement with an internal surface of trap side wall 38.

The opposite end 52 of shaft 40 is splined. Threaded insert 54 passes through opening 56 of the trap wall 38 and around end 52 of shaft 40. An annular packing member 58 also passes around the shaft 40 so that the shaft 40 may have its splined end 52 received and secured in packing bonnet 60 at end 62. An opposite end 64 of the packing bonnet 60 receives a screw 66 passing through rotatable actuating knob 68. A cap cover 70 covers the screw 66.

Actuating knob 68 is secured to packing bonnet 60 having a projection 72, projecting in a direction of needle indicator 74 extending from the actuating knob 68. The projection 72 fits into a detent 76 of threaded insert 54. The alignment of the needle indicator 74 representative of the alignment of the projection 72, detent 76 and sweeper bar 28 provides an external indication of the orientation of the sweeper bar inside of the trap body as shown in FIG. 1.

Accordingly, upon rotation of the sweeper bar in the direction of arrow 78 by rotation of actuating knob 68, in a direction from inlet end 12 to outlet end 14, will force any obstructions located in the U-shaped path between the inlet end 12 and outlet end 14 towards the outlet end 14 and the weir 20. During rotation of the sweeper bar, the needle indicator 74 will provide an indication of the location of the sweeper bar through the U-shaped path between the inlet end 12 and outlet end 14. The eventual interengagement of projection 72 moving with the actuating knob 68 and detent 76 will provide a locking of the sweeper bar in a vertical orientation, out of the way of the U-shaped path of travel of waste water through the trap. Therefore, the same U-shaped path as is provided by a P-trap without the present invention is established by the configuration and orientation of the sweeper bar of the present invention.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. A plumbing sink trap comprising:

a trap body having an inlet end for connection to a sink drain and an outlet end for connection to a drain line, and a sweeping mechanism located between said inlet end and said outlet end, said sweeping mechanism including two parallel side walls and a sweeper bar rotatable about 360° between said side walls about one end of said sweeper bar such that an opposite end thereof moves in a direction from said inlet end to said outlet end for moving an obstruction in a direction of said outlet end.

2. A plumbing sink trap as claimed in claim 1, wherein said sweeper bar is rotatable from an exterior of said trap body.

3. A plumbing sink trap as claimed in claim 2, wherein said sweeper bar is mounted on a shaft extending from said exterior to an interior of said trap body.

4. A plumbing sink trap as claimed in claim 2, wherein an actuating knob having a position indicator needle is connected to said sweeper bar by a shaft for indicating a position of said sweeper bar.

5. A plumbing sink trap as claimed in claim 4, wherein said sweeper bar is lockable in a vertical orientation.

6. A plumbing sink trap as claimed in claim 5, wherein a projection attached to said actuating knob engages in a detent in one of said two side walls to lock said sweeper bar in the vertical orientation.

7. A plumbing sink trap as claimed in claim 1, wherein said sweeper bar is normally oriented in a vertical orientation with side walls of said sweeper bar defining a portion of a U-shaped path extending between said inlet end and said outlet end.

8. A plumbing sink trap as claimed in claim 7, wherein said side walls of said sweeper bar are flat.

9. A plumbing sink trap as claimed in claim 8, wherein at least one of opposed ends of said sweeper bar is curved.

10. A plumbing sink trap comprising:

a trap body having an inlet end, an outlet end and a U-shaped path extending between said inlet end and said outlet end, and a sweeping mechanism substantially defining said U-shaped path when in a position of rest and including a sweeper bar movable from said position of rest to a position moving in a direction from said inlet end to said outlet end.

11. A plumbing sink trap as claimed in claim 10, wherein said sweeper bar is rotatable from an exterior of said trap body.

12. A plumbing sink trap as claimed in claim 11, wherein said sweeper bar is mounted on a shaft extending from said exterior to an interior of said trap body.

13. A plumbing sink trap as claimed in claim 10, wherein an actuating knob having a position indicator needle is connected to said sweeper bar by a shaft for indicating a position of said sweeper bar.

14. A plumbing sink trap as claimed in claim 13, wherein said sweeper bar is lockable in a vertical orientation.

15. A plumbing sink trap as claimed in claim 14, wherein a projection attached to said actuating knob engages in a detent in one of said two side walls to lock said sweeper bar in the vertical orientation.

* * * * *